US007840151B2

(12) United States Patent
Fujimoto

(10) Patent No.: US 7,840,151 B2
(45) Date of Patent: Nov. 23, 2010

(54) HEATING DEVICE, FIXING APPARATUS, AND IMAGE FORMING SYSTEM

(75) Inventor: Ippei Fujimoto, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 333 days.

(21) Appl. No.: 12/147,978

(22) Filed: Jun. 27, 2008

(65) Prior Publication Data

US 2009/0003867 A1 Jan. 1, 2009

(30) Foreign Application Priority Data

Jun. 27, 2007 (JP) ..... 2007-168707

(51) Int. Cl.
*G03G 15/20* (2006.01)

(52) U.S. Cl. ..... 399/70; 399/67; 399/69; 219/216

(58) Field of Classification Search ..... 399/67–70; 219/216

See application file for complete search history.

(56) References Cited

U.S. PATENT DOCUMENTS 5,319,428 A * 6/1994 Maruko et al.
2006/0165443 A1 7/2006 Yoshinaga et al.
2006/0177232 A1 8/2006 Ehara et al.

FOREIGN PATENT DOCUMENTS

JP 62-70886 4/1987
JP 3350315 * 9/2002
JP 2005-345989 12/2005

* cited by examiner

*Primary Examiner*—David M Gray
*Assistant Examiner*—G. M. Hyder
(74) *Attorney, Agent, or Firm*—Oblon, Spivak, McClelland, Maier & Neustadt, L.L.P.

(57) ABSTRACT

A heating device includes a heat applying member heated by a heat source, a pressure applying member pressure contacting the heat applying member with a prescribed pressure, and a temperature detection device that detects temperature of the heat applying member. A timing device is provided to count time elapsing from when the heat source starts heating the heat-applying member. A control device is provided to determine that heat application as a start up operation to the heating member is completed when the temperature detected by the temperature detection device reaches a prescribed threshold and the elapsing time counted by the timing device reaches a prescribed threshold.

14 Claims, 10 Drawing Sheets

FIG. 9

| AMBIENT TEMPERATURE | Tftemp | Tftime |
|---|---|---|
| 10 | 165 | 42 |
| 15 | 160 | 35 |
| 20 | 155 | 30 |
| 25 | 150 | 27 |
| 30 | 145 | 25 |

HEATING DEVICE, FIXING APPARATUS, AND IMAGE FORMING SYSTEM

CROSS REFERENCE TO RELATED APPLICATION

This application claims priority under 35 USC §119 to Japanese Patent Application No. 2007-168707, filed on Jun. 27, 2007, the entire contents of which are herein incorporated by reference.

BACKGROUND OF THE INVENTION

1. Field of the Invention

This invention relates to a heating device including a heat applying member heated by a heat source and a pressure applying member pressure contacting the heat member with a prescribed pressure for fixing a toner image onto a printing sheet by means of heat and pressure, a fixing apparatus including the heating device, and an image forming system, such as a copier, a printer, a facsimile, etc., including the fixing apparatus.

2. Discussion of the Background Art

A conventional fixing apparatus mounted on an image forming system performs fixing by applying heat and pressure to a printing medium fed between a heat applying member and a pressure applying member while pressurizing melted developer (toner) onto the printing medium.

Such a heat applying member is formed in a roller or belt state and installs a heat source, such as a halogen heater, an IH coil, etc. Otherwise, the heat source is installed in a roller that winds the belt state heat-applying member or is arranged in a circumferential section of the heat-applying member.

In this type of the fixing apparatus, a start up operation for heating the heat-applying member up to a temperature capable of fixing toner is needed as a warm up operation. The start up time is preferably short for a user, and is sometimes described in a brochure as a specification of a product.

Conventionally, a temperature priority mode is adopted, in which a start up operation is regarded as completed when temperature of the heat-applying member reaches a prescribed setting level.

However, since a time taken by the start up operation varies depending upon unevenness of parts of the heat-applying source in the temperature priority mode, the user is dissatisfied by the mode Conventional temperature and heat application control technologies are described in Japanese Patent Registration No. 3350315, and Japanese Patent Application Laid Open Nos. 2005-345989 and 62-70886. Specifically, a time priority mode is adopted in Japanese Patent Application Laid Open No. 62-70886, in which a start up operation is regarded as being completed when a prescribed time period has elapsed after a start up in order to make a start up time period constant.

However, the time priory mode can affect an image quality depending on a condition where a fixing apparatus is used. Specifically, since calorie supplied from a heat source per hour decreases when an input voltage thereto is low, temperature of the heat applying member decreases, so that a fixing error, such as a cold offset, etc., occurs. Further, calorie necessary to fix developer (toner) onto a printing medium varies depending on a condition such as ambient temperature.

Accordingly, it is hard to determine completion of a start up operation for the heat-applying member only based on the elapsing time from the starting up of heat application.

SUMMARY OF THE INVENTION

Accordingly, an object of the present invention is to improve such background arts technologies and provides a new and novel heating device.

Such a new and novel heating device comprises a heat applying member heated by a heat source, a pressure applying member pressure contacting the heat applying member with a prescribed pressure, and a temperature detection device that detects temperature of the heat applying member. A timing device is provided to count time elapsing from when the heat source starts heating the heat-applying member. A control device is provided to determine that heat application as a start up operation to the heat applying member is completed when the temperature detected by the temperature detection device reaches a prescribed threshold and the elapsing time counted by the timing device reaches a prescribed threshold.

In one aspect of the present invention, an ambient temperature-detecting device is provided to detect ambient temperature of the heat-applying member, and the temperature threshold is changed in accordance with the temperature detected by the ambient temperature-detecting device.

In another aspect of the present invention, the time threshold is changed in accordance with the temperature detected by the ambient temperature-detecting device.

In yet another aspect, both of the temperature threshold and the time threshold are changed in accordance with the temperature detected by the ambient temperature-detecting device.

In yet another aspect, a power-detecting device is provided to detect power supplied to the heat source, and the temperature threshold is changed in accordance with the power detected by the power-detecting device.

In yet another aspect, the time threshold is changed in accordance with the power detected by the power-detecting device.

In yet another aspect, both of the time threshold and the temperature threshold are changed in accordance with the power detected by the power-detecting device.

In yet another aspect, the temperature threshold is changed in accordance with both of the temperature detected by the ambient temperature-detecting device and the power detected by the power-detecting device.

In yet another aspect, the time threshold is changed in accordance with both of the temperature detected by the ambient temperature-detecting device and the power detected by the power-detecting device.

In yet another aspect, both of the temperature threshold and the time threshold are changed in accordance with both of the temperature detected by the ambient temperature detecting device and the power detected by the power-detecting device.

In yet another embodiment, a fixing apparatus includes a heat-applying member that applies heat, a pressure-applying member that applies pressure and the above-mentioned heat-applying device. A fixing operation is executed between the heat applying member and the pressure-applying member.

In yet another aspect of the present invention, the heat-applying member is one of roller and belt types, while the pressure-applying member is one of roller and belt types.

In yet another aspect, the pressure-applying member includes a contacting pad.

In yet another embodiment, an image forming system includes an image formation section that forms a toner image on a printing medium and a fixing section that applies a fixing operation to the printing medium. The fixing section includes the above-mentioned fixing device.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 9 illustrates an exemplary relation among ambient temp, a completion temperature Tftemp of a heat application start up operation, and a completion time Tftime of a heat application start up operation;

PREFERRED EMBODIMENTS OF THE PRESENT INVENTION

Figure 1:
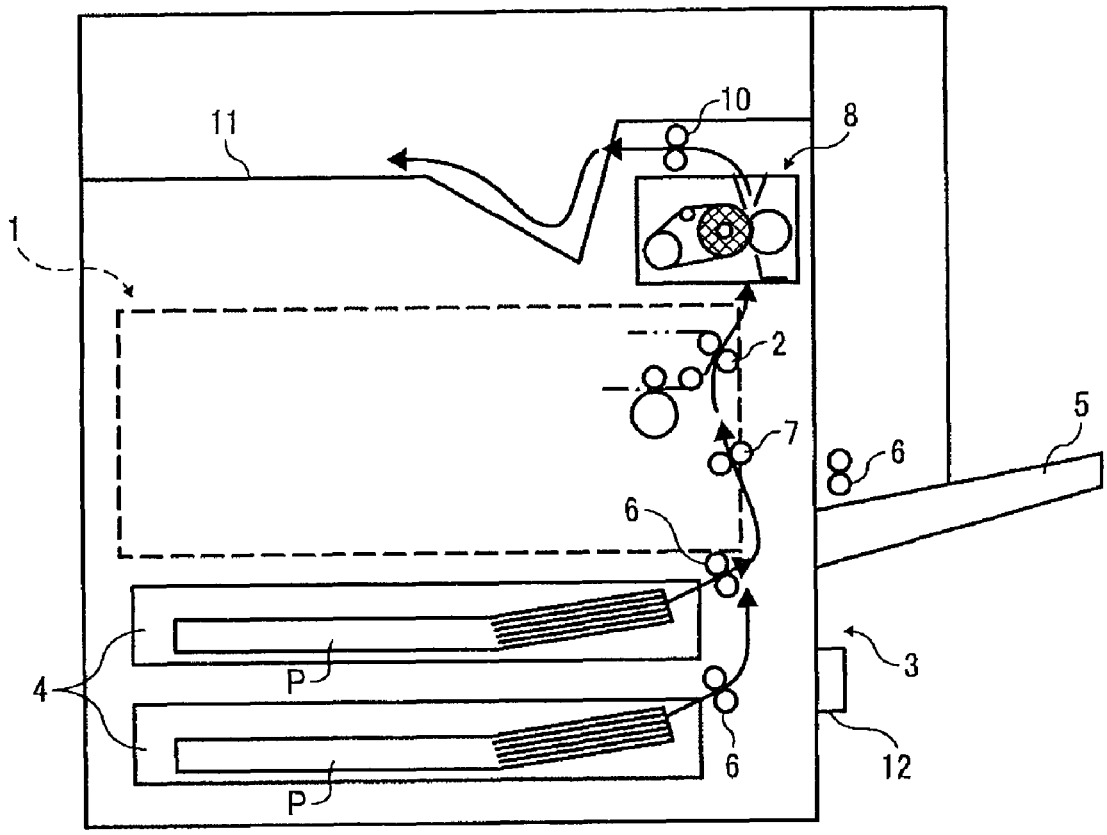
FIG. 1 illustrates an exemplary image forming system including an exemplary fixing apparatus of according to a first embodiment of the present invention.

Referring now to the drawing, wherein like reference numerals designate identical or corresponding parts throughout several views, in particular in FIG. 1, numeral 1 denotes an image formation section including a photo-conductive member for forming a latent image when exposed by an optical system, not shown, a developing section, not shown, for forming a visual toner image on the photo-conductive member by applying toner to the latent image formed on the photo-conductive member, and a transfer roller 2 for transferring the toner image onto a printing medium, such as a sheet, etc.

Numeral 3 denotes a sheet feeding section including plural sheet trays 4 (two steps in this case) each accommodating plural printing sheets P, a manual sheet tray 5, plural sheet feeding rollers 6 each arranged in the respective sections, and a registration roller 7.

Numeral 8 denotes a fixing section, later mentioned in more detail, for applying a fixing operation to a toner image on the printing sheet P after a transfer process by applying heat and pressure thereto.

Numeral 9 denotes a sheet ejection section including plural sheet ejection rollers 10 for ejecting the printing sheet P having been subjected to the fixing process, and a sheet ejection tray 11 receiving the printing sheet P thereon.

The printing sheet P is fed by the sheet feeding roller 6 from either the sheet feeding tray 4 or the manual sheet tray 5, and is lead to the transfer roller 2 by the registration roller 7. Then, the printing sheet P receives toner image transfer by means of the transfer roller 2. The printing sheet P is conveyed to a fixing section 8 after the transfer process. The toner image is then fixed to the printing sheet P while receiving application of the heat and pressure in the fixing section 8. The printing sheet P is then ejected onto the sheet ejection tray 11 when conveyed by the sheet ejection rollers 10.

Since a construction capable of upwardly and substantially vertically conveying the printing sheet P is employed, a traveling distance for the printing sheet P from the sheet feeding tray 4 to the sheet ejection tray 11 can be decreased, and accordingly, a time period when a printing sheet P of the first image formation arrives at the sheet ejection tray 11 can decrease.

Further, numeral 12 denotes a temperature and humidity sensor serving as an ambient temperature detection device that is attached to a side of an image forming system and detects ambient temperature and humidity in the vicinity of the image forming system.

Figure 2:
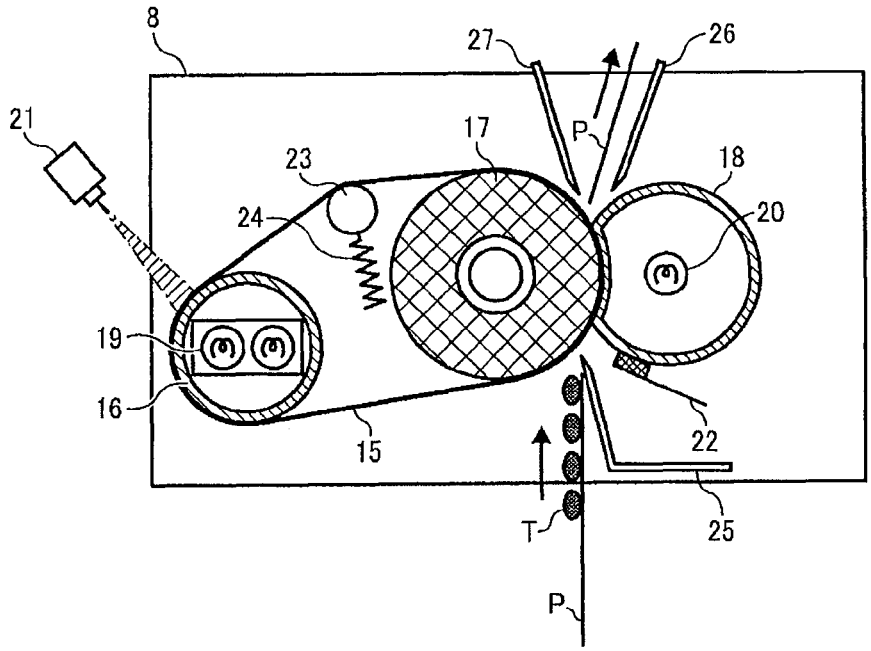
FIG. 2 illustrates details of the exemplary fixing apparatus of FIG. 1.

As shown in FIG. 2, a fixing section 8 includes an endless fixing belt 15 for conveying a sheet like printing medium such as a printing sheet P subjected to a fixing process, a heat applying roller 16 by winding and driving the fixing belt 15, and a fixing roller 17. Also included are heaters as heat sources respectively installed in the heat applying roller 16 and the pressure-applying roller 18, and a non-contact type thermistor 21 arranged opposing the heat-applying roller 16 via the fixing belt 15 as a temperature detection device for detecting temperature of the fixing belt 15.

The pressure-applying roller 18 includes a thermistor 22 for detecting temperature of the pressure-applying roller 18. The fixing belt 15 is depressed by a belt suspension member 23 and a bias member 24 from an inside toward an outside, thereby creating a tension.

A pair of inlet and outlet guide plates 25 and 26 are arranged for guiding a printing sheet P with their ends being positioned in the vicinity of a nip formed between the fixing roller 17 and the pressure applying roller 18 via the fixing belt 15. A separation member 27 is arranged on the side of the outlet guide plate 26 for separating the printing sheet P from the fixing belt 15.

As the heater 19, a heater having 1000 W (when a rating voltage is inputted) is utilized. As the heater 20, a heater having 300 W (when a rating voltage is inputted) is utilized. By using the heater having large calorie in the pressure-applying roller 16, temperature of the fixing belt 15 quickly increases and reduces a time period to be taken by heat application starting up.

Toner T as developer used in image formation according to one embodiment of the present invention includes plastic having elasticity and melts at the nip, thereby possibly causing a printing sheet P to wind around the fixing belt 15 and jam when the printing sheet P is ejected therefrom. Then, a plate like separation member 27 is arranged in the vicinity of the fixing belt 15 with a gap about 0.2 mm to 1.0 mm instead of a separation pick contacting the fixing belt 15.

Figure 3:
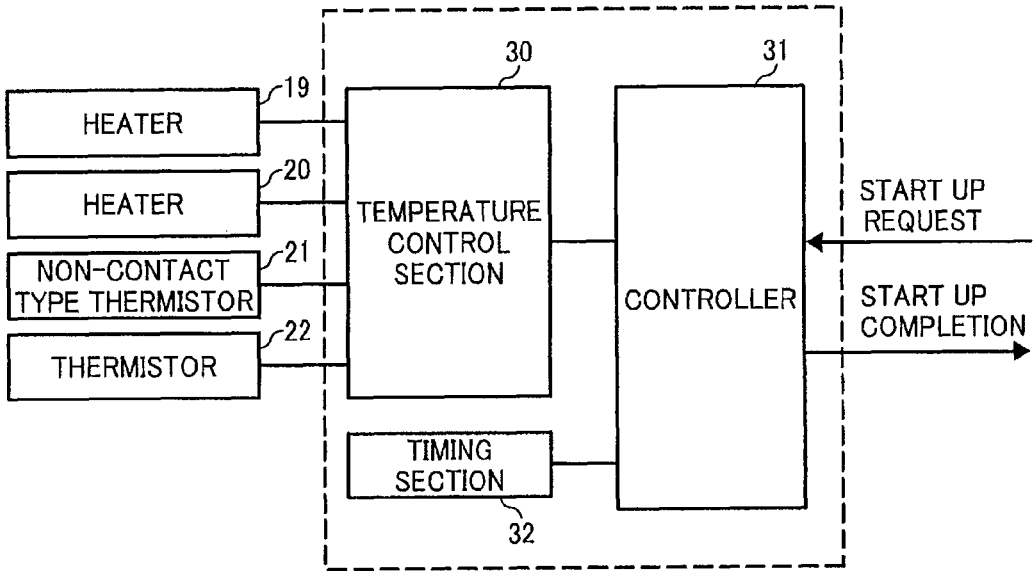
FIG. 3 illustrates an exemplary control section included in the fixing apparatus of FIG. 2.

As shown in FIG. 3, a control section 30 includes a temperature control section, a controller 31 such as a CPU (Central Processing Unit), and a timing section 32 as a time measurement device such as a timer. The temperature section 30 compares an output from either the non-contact type thermistor 21 or the thermistor 22 and a target control temperature and determines whether to turn on or off the heater 19 and/or 20. The timing section 32 starts counting a time when the fixing section receives a request for heat application start up and outputs an elapsed time to the controller 31.

Figure 4:
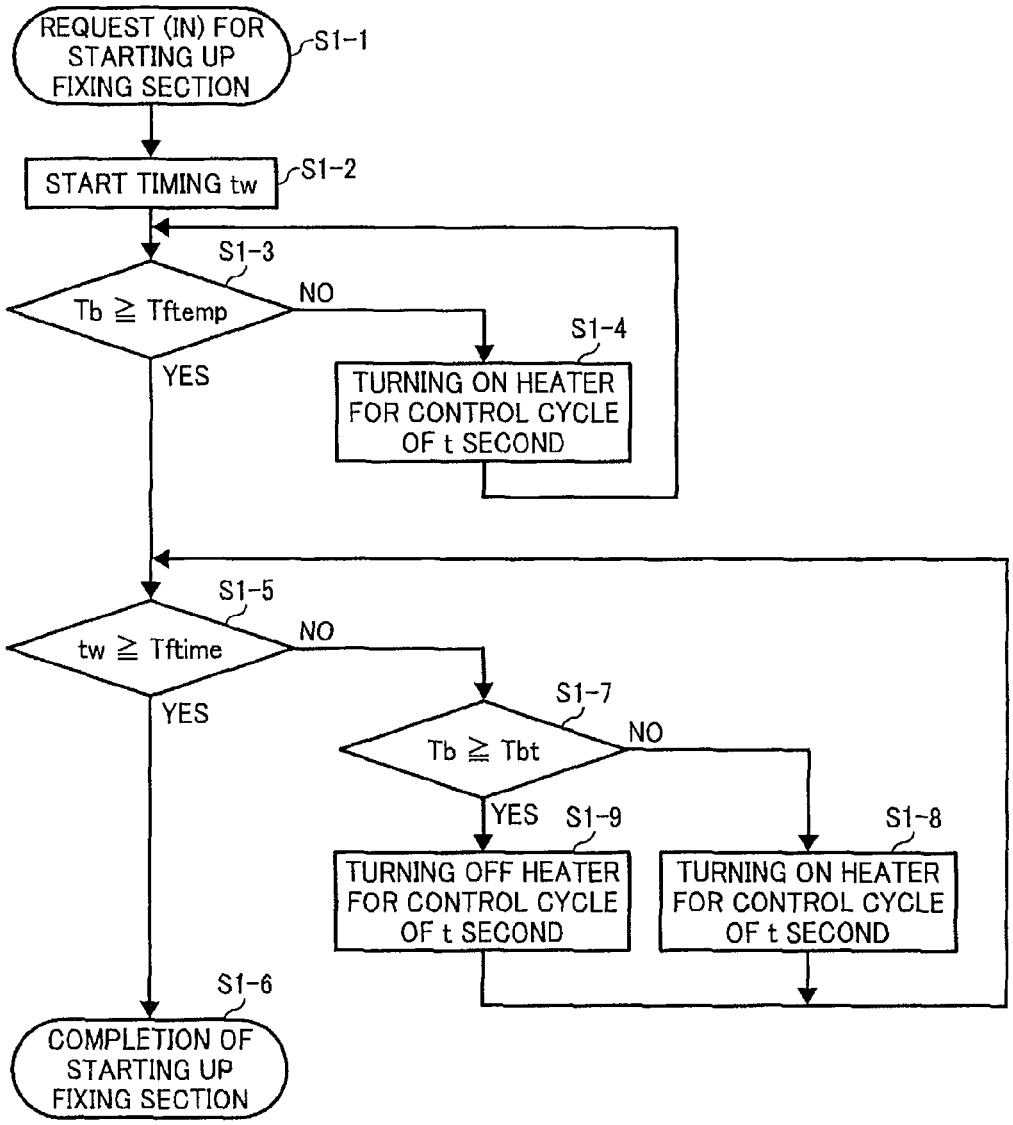
FIG. 4 illustrates an exemplary sequence for starting up heat application in the fixing apparatus of FIG. 2.

Now, an exemplary start up operation is described with reference to FIG. 4.

As shown, when a heat application request is made to the fixing section 8 in step S1-1, the controller 31 controls the timing section 32 to start counting a start up operation elapsed time tw in step S1-2. Then, the controller 31 compares a detection temperature Tb of the non-contact type thermistor 21 and a start up operation completion temperature (equivalent to a reload temperature: Temperature Threshold) Tftemp in step S1-3. Then, the controller 31 turns off the heater 19 for a control cycle t-second in step S1-4 when the detection temperature Tb is lower than the Tftemp (No, in step S1-3).

When the detection temperature Tb is higher than the Tftemp (Yes, in step S1-3), the controller 31 compares a start up operation elapsed time Tw with a start up operation completion time period (equivalent to a reload time: Time Threshold) Tftime in step S1-5. The heat application start up operation in the fixing section 8 is completed in step S1-6 when the Tw exceeds the start up operation completion time period Tftime (Yes, in step S1-5).

Whereas, the start up operation is continued when the start up operation elapsing time period Tw is not more than the start up operation completion time period Tftime (No, in step S1-5). Then, the controller 31 compares a detection temperature Tb of the non-contact type thermistor 21 with a target control temperature Tbt in step S1-7, and turns on the heater 19 in step S1-8, when the detection temperature Tb of the non-contact type thermistor 21 is lower than the target control temperature Tbt (No, in step S1-7). Then, the controller 31 turns off the heater 19 in step S1-9, when the detection temperature Tb is higher than the target control temperature Tbt (Yes, in step S1-7). These operations are repeated until the start up operation elapsed time Tw arrives at the start up operation completion time period Tftime (Yes, in step S1-5).

Figure 5:
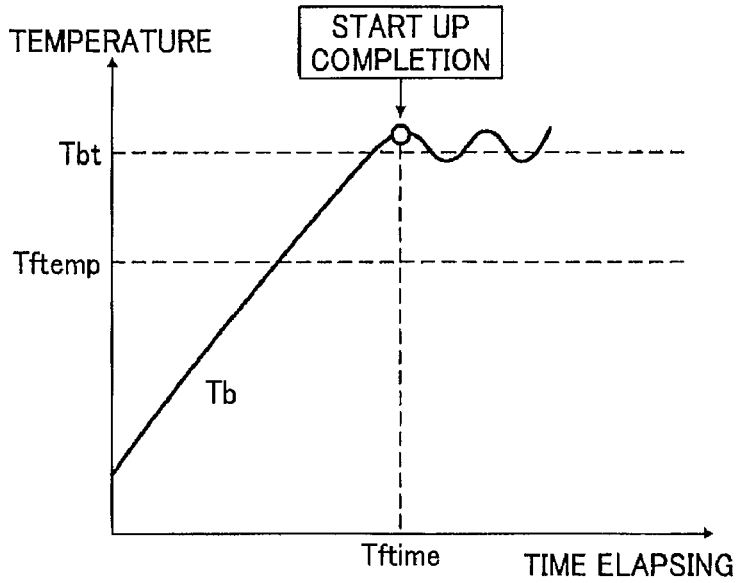
FIG. 5 illustrates an exemplary profile of temperature of a fixing belt when an exemplary start up operation of heat application is executed with an input voltage relatively lower according to one embodiment of the present invention.

An exemplary temperature profile of the fixing belt 15 obtained when an input voltage is relatively low, such as about 90v and the aforementioned heat application start up control is executed is described with reference to FIG. 5.

As shown, at the start up operation completion time period Tftime, the detection temperature Tb of the non-contact type thermistor 21 does not reach the start up operation completion temperature Tftemp, and thus the heat application start up operation is continued.

When the start up operation is regarded as being completed at the time of a start up operation completion time Tftime, the fixing belt 15 lacks calorie and creates a defective fixing performance such as cold offset. Thus, the start up operation is regarded as being completed when the fixing belt 15 comes to the temperature Tftemp capable of acquiring a suitable fixing performance.

Figure 6:
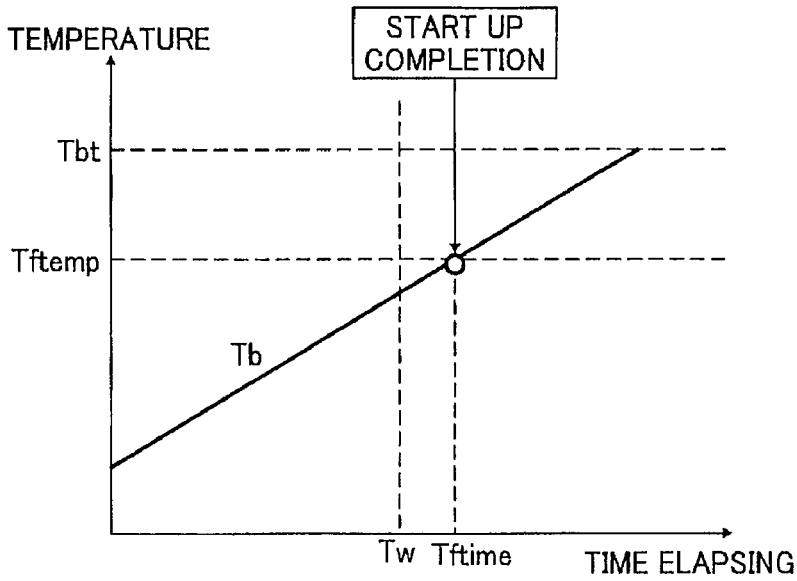
FIG. 6 illustrates an exemplary profile of temperature of a fixing belt when an exemplary start up operation of heat application is executed with an input voltage relatively higher according to another embodiment of the present invention.

In FIG. 6, a temperature profile of the fixing belt 15 is shown when an input voltage is relatively high, for example about 100v. When the detection temperature Tb of the non-contact type thermistor 21 reaches the Tftemp, the start up operation elapsing time Tw does not reach the start up operation completion time Tftime. Thus, heat application start up is continued. When the start up operation elapsing time Tw becomes equivalent to the start up operation completion time Tftime, the heat application start up operation is regarded as being completed.

Temperature of the fixing belt 4 when the heat application start up operation is completed increases up to almost the target control temperature Tbt, so that a sufficient fixing performance can be obtained.

Figure 7:
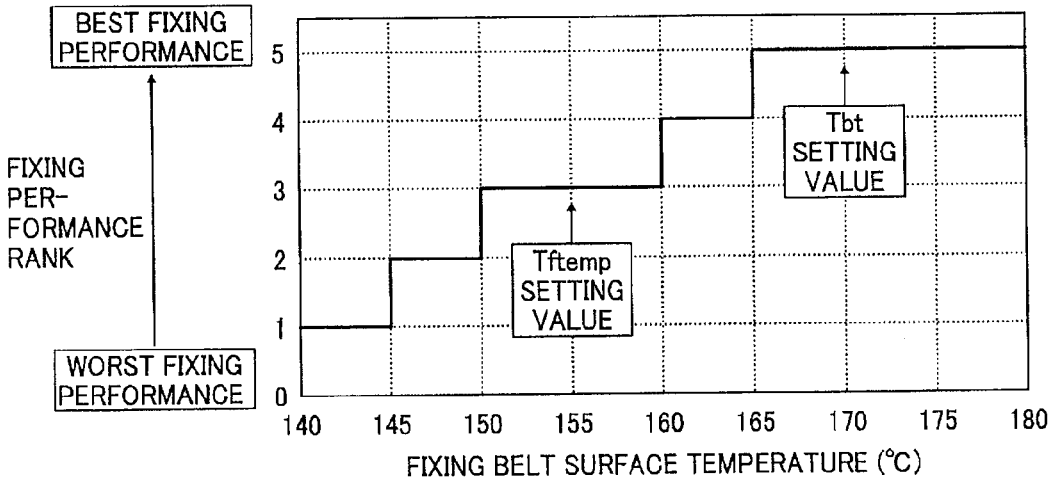
FIG. 7 illustrates an exemplary relation between a surface temperature and a fixing performance of the fixing belt.

With reference to FIG. 7, a fixing performance is ranked from first to fifth levels. The first and second levels represent insufficient fixing, in which the cold offset occurs or toner drops when touched with a finger. The third lank represents a level in which toner does not drop even touched with the finger and thus no problem occurs. However, brilliance of color sometimes deteriorates when a color copy is made in the level. In the fifth rank, an image quality such as brilliance, etc., is sufficient.

A start up operation completion temperature Tftemp for the fixing belt 15 is set to about 155 centigrade. This is because completion of a heat application start up operation is to be determined based on the fixing performance third rank as a target, which does not raise any practical problems while reducing a time to be taken by the heat application start up operation when an input voltage is relatively low.

When the input voltage is relatively high, the temperature of the fixing belt 15 can be increased up to a level capable of obtaining a sufficient fixing performance at the start up operation completion time Tftime as shown in FIG. 7.

Figure 8:
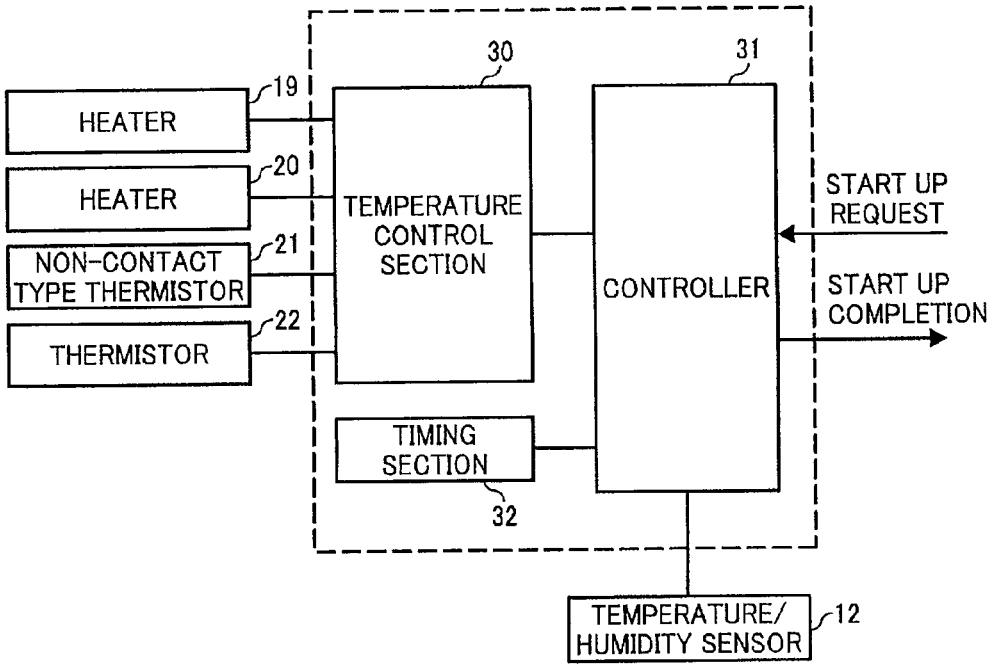
FIG. 8 illustrates an exemplary configuration of a control section of a fixing apparatus according to a second embodiment of the present invention.

Now, an exemplary control section of a second embodiment of a fixing apparatus is described with reference to FIG. 8. A control section in this embodiment is the same as the control section of the first embodiment of FIG. 3 and executes controlling using detection info transmitted from the temperature/humidity sensor 12 of FIG. 1. Specifically, ambient temperature of an apparatus body is detected, and one of the start up operation completion temperature Tftemp and the start up operation completion time Tftime is changed, accordingly.

Generally, temperature of a fixing belt 15 quickly increases when an apparatus is installed at a place where ambient temperature is high, because initial temperature of the fixing apparatus is high and heat release to ambient decreases when the start up operation is executed. Further, since initial temperature of a printing sheet is also high, temperature necessary to fix toner can be lower.

An exemplary relation among the ambient temp, a heat application start up operation completion temperature Tftemp, and a heat application start up operation completion time Tftime is illustrated in FIG. 9 as a table.

Figure 10:
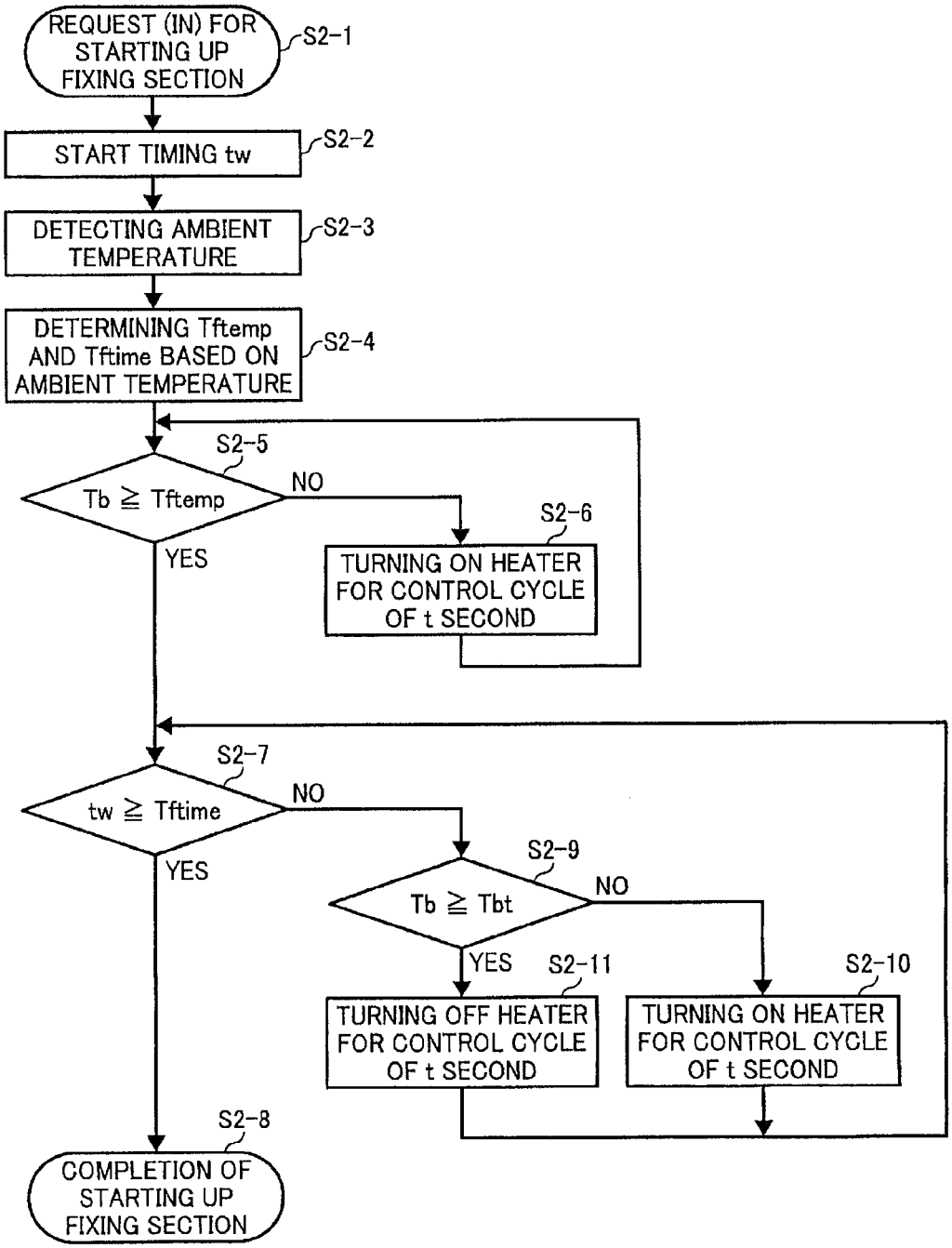
FIG. 10 illustrates an exemplary sequence of the heat application start up operation executed in the fixing apparatus of the second embodiment.

An exemplary sequence of a heat application start up operation executed in the second embodiment of the fixing section is described with reference to FIG. 10. The temperature/humidity sensor 12 detects ambient temperature in steps S2-3, and a start up operation completion temperature Tftemp and a heat application start up operation completion time Tftime are determined in accordance with the detection result with reference to the data table of FIG. 9 in step S2-4. The other steps S2-1, S2-2, and S2-5 to S2-11 are the same as those S1-1, S1-2, and S1-3 to S1-9 of FIG. 4.

Figure 11:
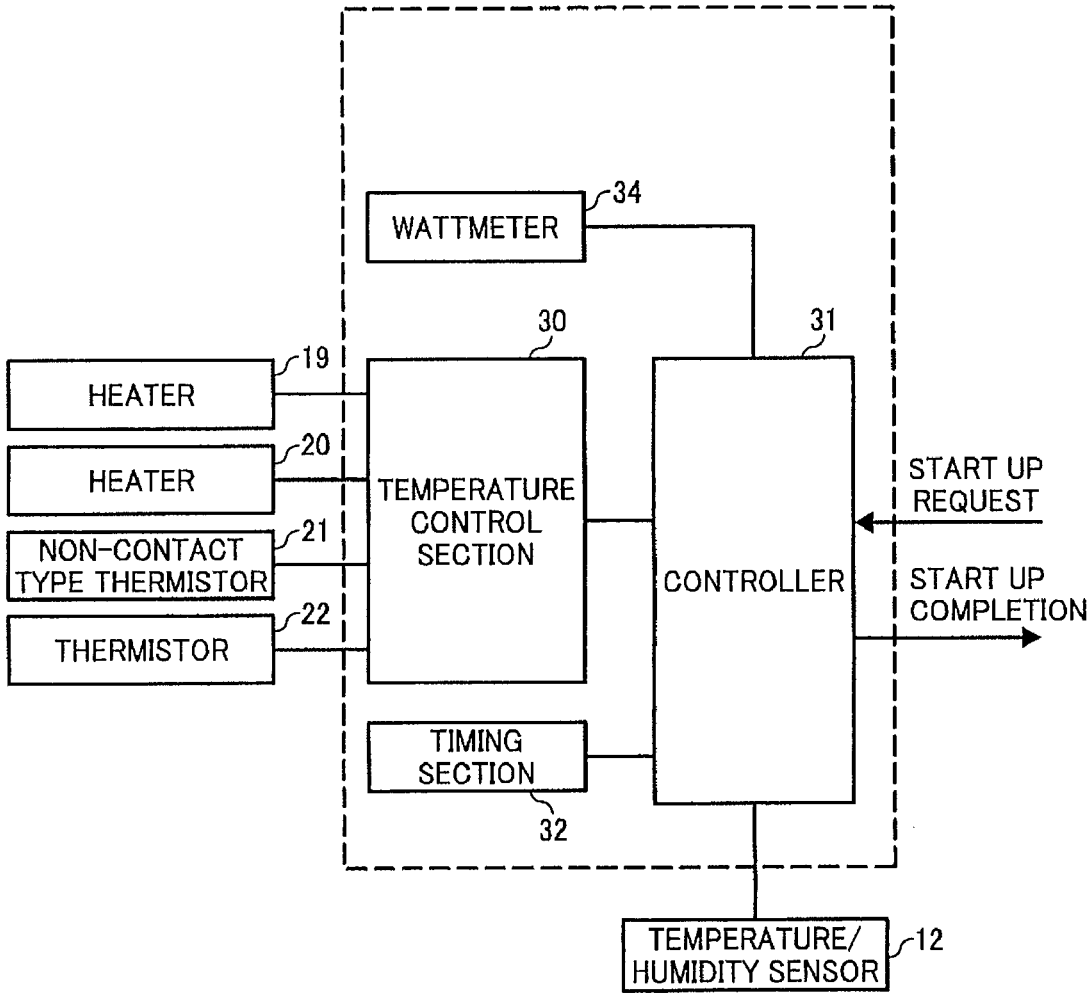
FIG. 11 illustrates an exemplary configuration of a control section included in a fixing apparatus of a third embodiment of the present invention.

Now, an exemplary control section of a third embodiment of a fixing apparatus is described with reference to FIG. 11. This control section is substantially the same as the control section of the second embodiment of FIG. 8, and executes controlling also based on detection info transmitted from a power meter 34 that detects power supplied to an apparatus.

Specifically, the power supplied to the apparatus is detected and one of the start up operation completion temperature Tftemp and the start up operation completion time Tftime is changed, accordingly.

Figure 12:
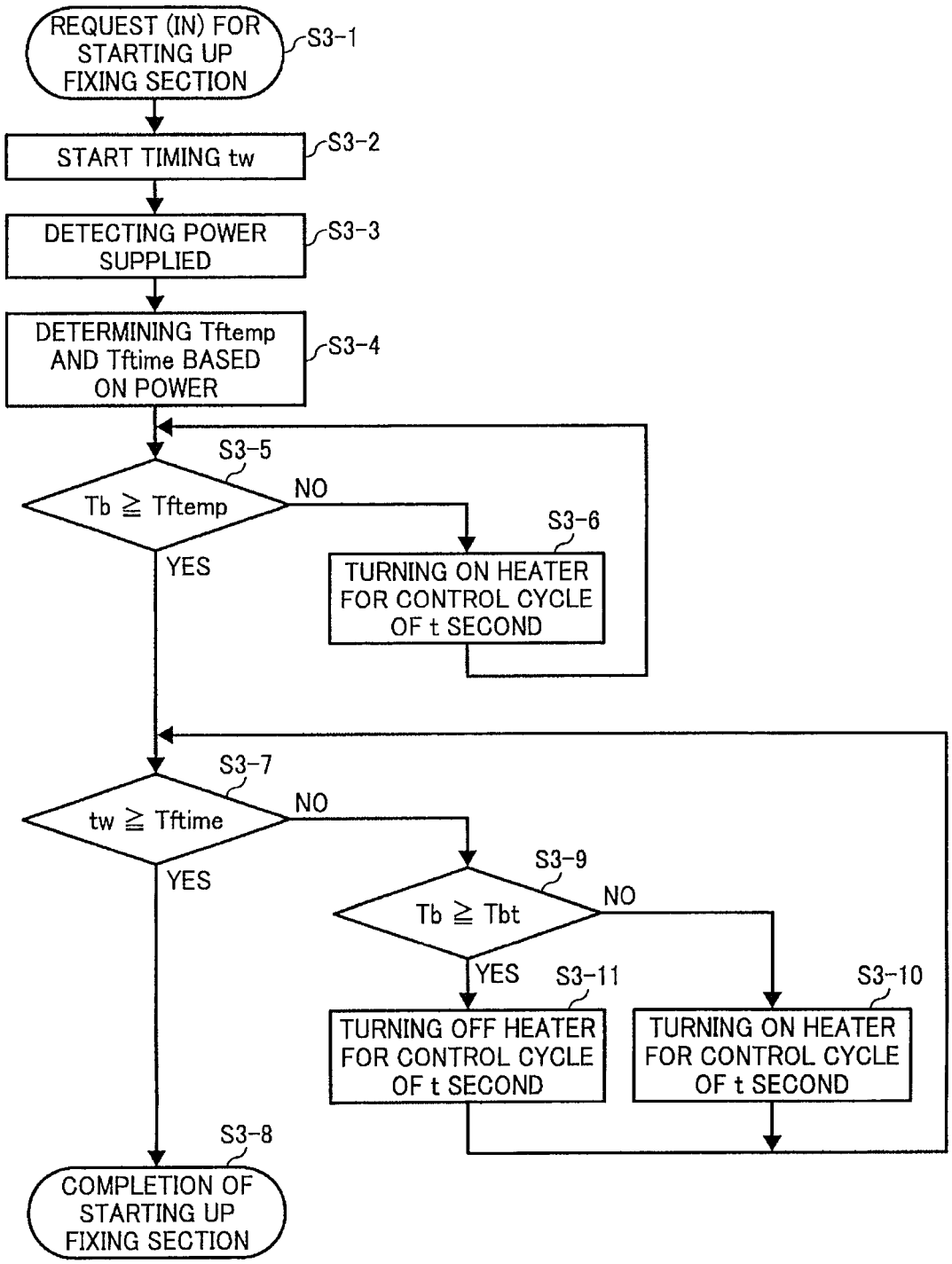
FIG. 12 illustrates an exemplary sequence of the heat application start up operation executed in the fixing apparatus of the third embodiment.

An exemplary sequence of a heat application start up operation executed in the third embodiment of the fixing section is described with reference to FIG. 12. The power meter 34 detects power supplied in steps S3-3, and a start up operation completion temperature Tftemp and a heat application start up operation completion time Tftime are determined by matching the power detection result with data to which correspondence is previously set correspondence thereto in step S3-4. The other steps S3-1, S3-2, and S3-5 to S3-11 are the same as those S1-1, S1-2, and S1-3 to S1-9 of FIG. 4.

When the power is large, temperature of the fixing belt 15 quickly increases because calorie of heater 19 of the heat source becomes large. Further, since drop of temperature of the fixing belt 15 becomes small when a sheet is fed after completion of the heat application start up operation, the start up operation completion temperature can be lowered.

Figure 13:
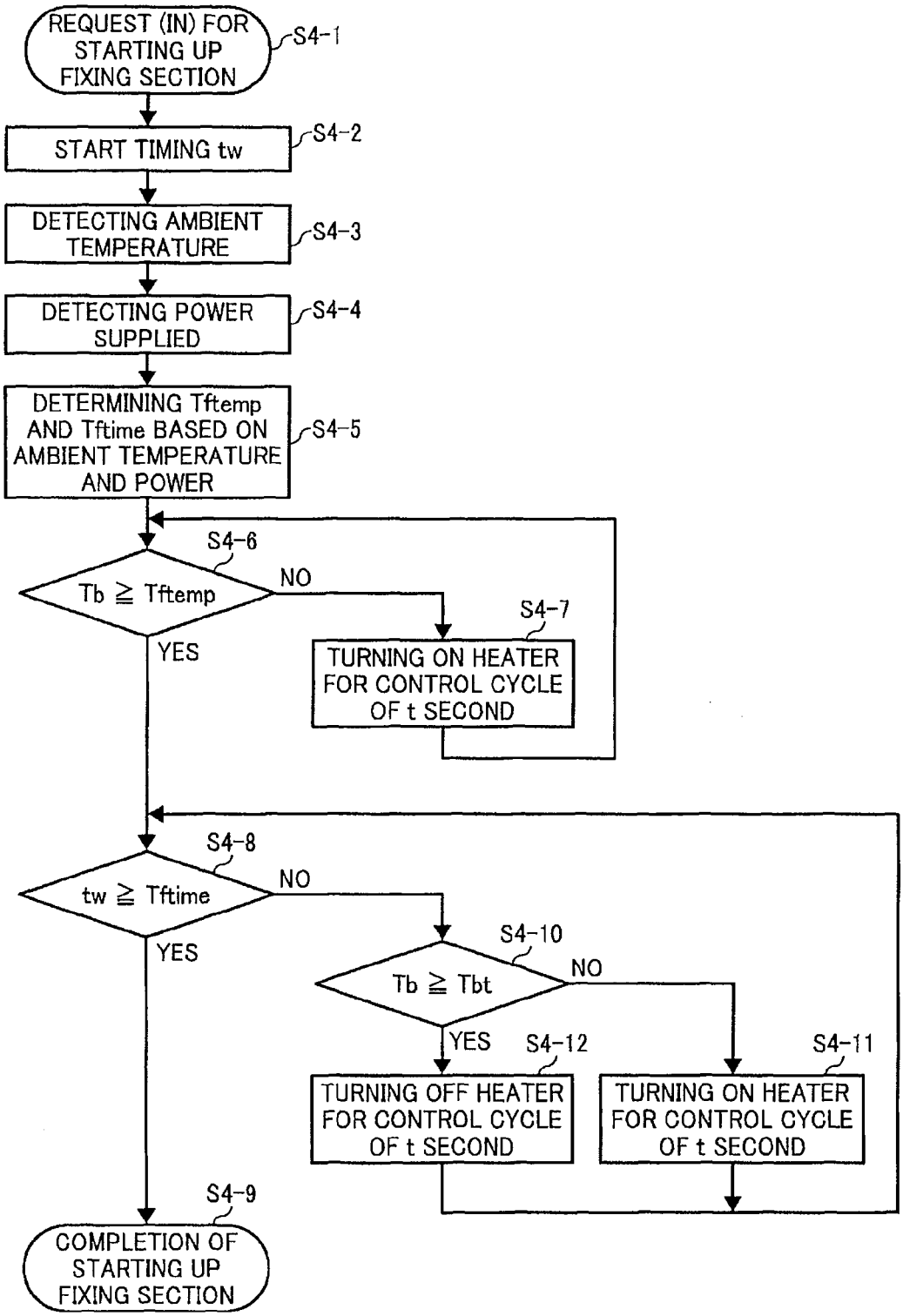
FIG. 13 illustrates an exemplary sequence of the heat application start up operation executed in a fixing apparatus according to a fourth embodiment.

An exemplary sequence of a heat application start up operation executed in the fixing section of a fourth embodiment is described with reference to FIG. 13. This embodiment includes the same configuration with the control section of the third embodiment of FIG. 11. Specifically, in steps S4-3 and S4-5, the temperature/humidity sensor 12 detects both of an ambient temperature and a power supplied from the power meter 34. Then, a start up operation completion temperature Tftemp and a start up operation completion time Tftime are determined by matching these detection results with previously set correspondence thereto. The other steps S4-1, S4-2, and S4-6 to S4-12 are the same as those S1-1, S1-2, and S1-3 to S1-9 of FIG. 4.

The heat applying device is not limited to the type illustrated in FIG. 2, and includes a belt type installing a heater 19. Further, the pressure applying member can be a belt member or a pressure pad.

According to this embodiment, using a low calorie fixing belt 15 and thus reducing a time taken by heat application start up operation, while appropriately combining configurations of the above-mentioned several embodiments, a fixing apparatus capable of obtaining a stable fixing performance can be obtained.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A heating device comprising:

a heat applying member heated by a heat source;

a pressure applying member pressure contacting the heat applying member with a prescribed pressure;

a temperature detection device configured to detect temperature of the heat applying member;

a timing device configured to count time elapsing from when the heat source starts heating the heat applying member; and a control device configured to determine that heat application as a start up operation to the heat applying member is completed when the temperature detected by the temperature detection device reaches a prescribed threshold and the elapsing time counted by the timing device reaches a prescribed threshold.

2. The heating device as claimed in claim 1, further comprising an ambient temperature detecting device configured to detect ambient temperature of the heat applying member, wherein the temperature threshold is changed in accordance with the temperature detected by the ambient temperature detecting device.

3. The heating device as claimed in claim 1, further comprising an ambient temperature detecting device configured to detect ambient temperature of the heat applying member, wherein the time threshold is changed in accordance with the temperature detected by the ambient temperature detecting device.

4. The heating device as claimed in claim 1, further comprising an ambient temperature detecting device configured to detect ambient temperature of the heat applying member, wherein both of the temperature threshold and the time threshold are changed in accordance with the temperature detected by the ambient temperature detecting device.

5. The heating device as claimed in claim 1, further comprising a power detecting device configured to detect power supplied to the heat source, wherein the temperature threshold is changed in accordance with the power detected by the power detecting device.

6. The heating device as claimed in claim 1, further comprising a power detecting device configured to detect power supplied to the heat source, wherein the time threshold is changed in accordance with the power detected by the power detecting device.

7. The heating device as claimed in claim 1, further comprising a power detecting device configured to detect power supplied to the heat source, wherein both of the time threshold and the temperature threshold are changed in accordance with the power detected by the power detecting device.

8. The heating device as claimed in claim 1, further comprising:

an ambient temperature detecting device configured to detect ambient temperature of the heat applying member; and a power detecting device configured to detect power supplied to the heat source;

wherein the temperature threshold is changed in accordance with both of the temperature detected by the ambient temperature detecting device and the power detected by the power detecting device.

9. The heating device as claimed in claim 1, further comprising:

an ambient temperature detecting device configured to detect ambient temperature of the heat applying member; and a power detecting device configured to detect power supplied to the heat source;

wherein the time threshold is changed in accordance with both of the temperature detected by the ambient temperature detecting device and the power detected by the power detecting device.

10. The heating device as claimed in claim 1, further comprising:

an ambient temperature detecting device configured to detect ambient temperature of the heat applying member; and a power detecting device configured to detect power supplied to the heat source;

wherein the temperature threshold and the time threshold are changed in accordance with both of the temperature detected by the ambient temperature detecting device and the power detected by the power detecting device.

11. A fixing apparatus comprising;

a heat applying member heated by a heat source;

a pressure applying member pressure contacting the heat applying member with a prescribed pressure;

a temperature detection device configured to detect temperature of the heat applying member;

a timing device configured to count time elapsing from when the heat source starts heating the heat applying member; and a control device configured to determine that heat application as a start up operation to the heat applying member is completed when the temperature detected by the temperature detection device reaches a prescribed threshold and the elapsing time counted by the timing device reaches a prescribed threshold;

wherein a fixing operation is executed between the heat applying member and the pressure applying member.

12. The fixing apparatus as claimed in claim 11, wherein said heat applying member is one of roller and belt types, and wherein sad pressure applying member is one of roller and belt types.

13. The fixing apparatus as claimed in claim 11, wherein said pressure applying member includes a contacting pad.

14. An image forming system comprising:

an image formation section configured to form a toner image on a printing medium;

a heat applying member heated by a heat source;

a pressure applying member pressure contacting the heat applying member with a prescribed pressure;

a temperature detection device configured to detect temperature of the heat applying member;

a timing device configured to count time elapsing from when the heat source starts heating the heat applying member; and a control device configured to determine that heat application as a start up operation to the heat applying member is completed when the temperature detected by the temperature detection device reaches a prescribed threshold and the elapsing time counted by the timing device reaches a prescribed threshold;

wherein said heat applying member and the pressure applying member cooperatively fixed the toner image onto the printing medium.

* * * * *